US008256486B1

(12) United States Patent
Thomas

(10) Patent No.: US 8,256,486 B1
(45) Date of Patent: Sep. 4, 2012

(54) WATER ACCUMULATION PREVENTION SYSTEMS, DEVICES AND METHODS FOR AWNING STRUCTURES

(76) Inventor: Robert B. Thomas, Bothell, WA (US)

( * ) Notice: Subject to any disclaimer, the term of this patent is extended or adjusted under 35 U.S.C. 154(b) by 0 days.

(21) Appl. No.: 13/338,892

(22) Filed: Dec. 28, 2011

Related U.S. Application Data

(60) Provisional application No. 61/561,173, filed on Nov. 17, 2011.

(51) Int. Cl.
*E04F 10/06* (2006.01)

(52) U.S. Cl. ..... 160/65; 160/44; 160/70

(58) Field of Classification Search ..... 160/66–72, 160/78–81, 65, 22, 264, 44; 135/88.11, 88.12; 296/98, 100.13
See application file for complete search history.

(56) References Cited

U.S. PATENT DOCUMENTS

| | | | | | |
|---|---|---|---|---|---|
| 1,905,339 | A * | 4/1933 | Brown | 160/22 |
| 2,880,795 | A * | 4/1959 | Macy et al. | 160/56 |
| 3,991,805 | A * | 11/1976 | Clauss | 160/22 |
| 4,075,723 | A * | 2/1978 | Bareis et al. | 114/361 |
| 4,801,119 | A * | 1/1989 | Pelletier | 248/354.5 |
| 5,174,352 | A * | 12/1992 | Murray et al. | 160/67 |
| 5,203,393 | A * | 4/1993 | Blevins et al. | 160/67 |
| 5,207,255 | A * | 5/1993 | Shannon | 160/65 |
| 5,449,032 | A * | 9/1995 | Blevins et al. | 160/80 |
| 6,363,664 | B1 * | 4/2002 | Brutsaert | 52/74 |
| 6,378,591 | B1 * | 4/2002 | McCoy | 160/67 |
| 6,494,246 | B1 * | 12/2002 | Blevins | 160/67 |
| 6,598,612 | B1 * | 7/2003 | Crowe | 135/88.12 |
| 6,957,679 | B2 * | 10/2005 | Powell et al. | 160/64 |
| 7,017,976 | B1 * | 3/2006 | Rutherford et al. | 296/163 |
| 7,188,889 | B2 * | 3/2007 | Wagner et al. | 296/163 |
| 7,628,194 | B2 * | 12/2009 | Wagner et al. | 160/22 |
| 2008/0135508 | A1 | 6/2008 | Fogolin et al. | 211/105.1 |

* cited by examiner

*Primary Examiner* — David Purol
(74) *Attorney, Agent, or Firm* — Seed IP Law Group PLLC

(57) ABSTRACT

A bow system is provided for coupling between a pair of arm members of an awning structure in a mounting region located beneath an area corresponding to a leading portion of an awning sheet thereof. A bow member of the bow system is aligned generally parallel to a lead member of the awning structure and is configured to flex upwardly to elevate a portion of the awning sheet when the awning is in a deployed configuration to prevent the accumulation of water or debris thereon. The bow member may automatically flex as the awning structure moves from a retracted configuration toward the deployed configuration. Other prop devices and methods of preventing the accumulation of water or debris on awning structures using bow systems and other prop devices are also provided.

20 Claims, 16 Drawing Sheets

WATER ACCUMULATION PREVENTION SYSTEMS, DEVICES AND METHODS FOR AWNING STRUCTURES

BACKGROUND

1. Technical Field

This disclosure generally relates to systems, devices and methods for elevating a portion of an awning sheet of an awning structure to prevent the accumulation of water and other debris thereon, and in particular, various systems and devices configured to be installed on conventional awning structures to elevate a portion of an awning sheet thereof.

2. Description of the Related Art

Awnings are well known devices which attach to various structures, such as, for example, residential homes and recreational vehicles, to provide protection from rain, sun and other elements.

FIGS. 1 and 2 show one particular conventional awning structure 10. The awning structure 10 includes a retractable awning sheet 12 coupled between a base member 14 and a lead member 16. The lead member 16 is retractably extendable to move between an extended position in which the awning sheet 12 is supported between the base member 14 and the lead member 16 in a cantilevered manner from a structure 22, such as a house as shown in FIG. 1, and a retracted position in which the awning sheet 12 is collected within the base member 14 near the structure 22. The lead member 16 is coupled to the base member 14 by a pair of extendable arms 18 which articulate between a collapsed configuration and an expanded configuration to move the lead member 16 between the retracted position and the extended position, respectively. Further details of this type of awning structure 10 can be found in U.S. Pat. No. 6,957,679, the entire content of which is incorporated herein by reference in its entirety.

FIG. 10 shows another conventional awning structure 10". Similar to the aforementioned awning structure 10, the awning structure 10" of FIG. 10 includes a retractable awning sheet 12" coupled between a base member 14" and a lead member 16". The lead member 16" is retractably extendable to move between an extended position in which the awning sheet 12" is supported in an extended manner between the base member 14" and the lead member 16", as shown in FIG. 10, and a retracted position in which the awning sheet 12" is collected within the base member 14". The base member 14" is securely coupled to a house structure 22" and the lead member 16" is coupled to the base member 14" by a pair of telescoping or articulating arms 18". The lead member 16" is also supported by a pair of telescoping or articulating legs 19 which may be secured to a base or floor structure 26, as shown in FIG. 10, or the house structure 22" during use.

With reference to FIGS. 1 and 10, when deployed for use, the awning sheets 12, 12" of such conventional awning structures 10, 10" often accumulate water 20, 20" and/or debris which can create adverse safety conditions and other undesired consequences, such as, for example, damage to the awning structures 10, 10". Similar problems exist for other conventional awnings. To address this common problem, various devices, including bow-like devices, have been designed to interface with awning structures to prevent or reduce the accumulation of water and debris thereon. Examples of such devices can be found, for example, in U.S. Pat. Nos. 5,174,352; 5,203,393; 5,449,032; and 6,494,246. These devices, however, suffer from a variety of deficiencies including, for example, cumbersome assembly and/or installation requirements. In addition, many known devices for preventing the accumulation of water on awning structures interfere with the ability to retract the awning sheet, thereby often requiring the devices to be removed prior to retraction and storage of the awning sheet. Still further, many known devices for preventing the accumulation of water on awnings are overly complex, often requiring the use of many bow-like elements and associated mounting components.

BRIEF SUMMARY

Embodiments described herein provide various systems and devices for use with awning structures and related methods which are particularly well adapted for preventing the accumulation of water and other debris on the surface of an awning sheet or canopy thereof in a particularly efficient form factor. According to some embodiments, the systems, devices and related methods provide particularly efficient mechanisms for preventing the accumulation of water and other debris in a package that is relatively easy to install and uninstall, if needed. In addition, some embodiments of the systems, devices and related methods described herein provide particularly versatile systems and devices which do not require disassembly when retracting and storing the awning.

Some embodiments described herein are directed to bow systems well adapted to prevent the accumulation of water and other debris on the surface of an awning sheet or canopy. Embodiments of these bow systems and related methods may provide particularly versatile systems which flex automatically when the awning sheet is extended for use and relax automatically when the awning sheet is retracted for storage.

According to one embodiment, a bow system for a retractable awning structure may be summarized as including a pair of couplers, each coupler having a base portion configured to engage a portion of a respective one of a pair of extendible arms of the awning and having a bow support portion coupled to the base portion to move relative the base portion during extension and retraction of the awning; and a bow coupleable at intermediate positions along a longitudinal length thereof to the pair of extendible arms of the awning by the pair of couplers, the bow including a bow member configured to flex into a curved configuration as the awning moves from a retracted position to an extended position, and the bow including a tension device coupled between opposing ends of the bow member to assist in moving the bow member to the curved configuration as the awning moves toward the extended position.

The base portion of each coupler may include a saddle sized and shaped to closely receive the portion of the respective one of the pair of extendible arms of the awning. The saddle may be configured to snap-fit onto the portion of the respective one of the pair of extendible arms of the awning. The base portion of each coupler may further include at least one fastener for fixing the base portion to the respective extendible arm of the awning. Each coupler may include a joint between the base portion and the bow support portion to enable the bow support portion to pitch and yaw relative to the base portion when the awning moves between the retracted position and the extended position. The joint may include at least one of a ball and socket joint, a universal joint and a clevis joint. The bow support portion of each coupler may include a tubular support section sized and shaped to slidably receive the bow member. The bow member may be a cylindrical tube and the bow support portion of each coupler may include a cylindrical tubular support section. The bow member may be a flat bar and the bow support portion of each coupler may include a rectangular tubular support section. The tension device may include a tension adjuster to adjust an amount of tension between the opposing ends of the bow member. The tension device may be coupled to each of the pair of couplers such that, at each of opposing ends of the bow system, the bow member, the tension device and the respective coupler resemble a triangular configuration when the bow system is in operation and the awning is in the extended position. During operation, the bow member may automatically flex toward the curved configuration as the awning moves toward the extended position. The bow member may include a plurality of bow member sections coupled together in an abutting relationship. The bow system may be packaged as an awning accessory kit.

The bow system may further include a supplemental bow coupleable at intermediate positions along a length thereof to one of the pair of extendible arms of the awning and a third extendible arm of the awning, the supplemental bow including a tension device coupled between opposing ends thereof to move a bow member of the supplemental bow to a curved configuration. One of the pair of couplers may be configured to support each of the bow and the supplemental bow.

According to another embodiment, a bow system for an awning structure may be summarized as including a pair of couplers, each coupler configured to engage a portion of a respective one of a pair of arms of the awning in a mounting region located beneath an area corresponding to a leading portion of the awning sheet adjacent a lead member of the awning when the awning is in a deployed configuration; and a bow member coupleable between the pair of couplers, the bow member configured to align generally parallel to the lead member and flex upwardly to elevate a portion of the awning sheet when the awning is in the deployed configuration.

Each coupler may include a base portion sized and shaped to closely receive the portion of the respective one of the pair of arms of the awning. The base portion may be configured to snap-fit onto the portion of the respective one of the pair of arms of the awning. The base portion of each coupler may further include at least one fastener for fixing the base portion to the respective one of the pair of arms of the awning. Each coupler may include an upper portion configured to receive one of opposing ends of the bow member. Each coupler may include an upper portion which defines a channel to receive one of opposing ends of the bow member, the channel including a series of apertures to selectively adjust a mounting location of the bow member. Each coupler may include an upper portion which defines a channel to receive a respective intermediate bow adjustment device, each intermediate bow adjustment device pivotally coupled to the coupler at a first end and coupled to the bow member at a second end. The channel of each coupler may include a series of apertures to selectively adjust a mounting location of the respective intermediate bow adjustment device. Each intermediate bow adjustment device may further include a series of apertures to selectively adjust a mounting location of the bow member.

According to another embodiment, an awning system may be summarized as including an awning having an awning sheet coupled between a base member and a lead member to form a canopy structure when the awning is in a deployed configuration in which the lead member is spatially offset from the base member, the lead member supported in space at least in part by a pair of arm members when the awning is in a deployed configuration; and a bow system coupled between the pair of arm members in a mounting region located beneath an area corresponding to a leading portion of the awning sheet adjacent the lead member when the awning is in the deployed configuration, the bow system including a bow member aligned generally parallel to the lead member and configured to flex upwardly to elevate a portion of the awning sheet when the awning is in the deployed configuration.

The pair of arms may be extendible and wherein the bow member may automatically flex upwardly during operation to elevate the portion of the awning sheet when the pair of arms move toward an extended position to transition the awning to the deployed configuration. The bow system may include a pair of couplers, each coupler having a base portion configured to engage a portion of a respective one of the pair of arms of the awning and having a bow support portion coupled to the base portion to move relative the base portion as the awning moves between the deployed configuration and a retracted configuration. The bow system may include a pair of couplers, each coupler configured to engage a portion of a respective one of the pair of arms of the awning and to receive one of opposing ends of the bow member, a distance between the couplers being less than a length of the bow member such that, when the bow member is received in the couplers and tensioned, the bow member flexes upwardly to elevate the portion of the awning sheet.

The awning system may further include a prop device configured to couple to at least one of the arm members of the awning, the prop device having a sheet support structure with a generally convex upper surface to interface with the awning sheet when the prop device is installed for use.

According to another embodiment, an awning sheet support device is provided for preventing the accumulation of water on an awning sheet of an awning. The awning sheet support device may be summarized as including a prop device having a coupler to couple the prop device to at least one arm member of the awning and having a sheet support structure with a generally convex upper surface to interface with a portion of the awning sheet when the prop device is installed for use. The coupler of the prop device may have an engagement portion configured to selectively engage the arm member of the awning and may be configured to support the sheet support structure in an upwardly directed orientation. The sheet support structure of the prop device may be pivotably supported to enable an orientation of the generally convex upper surface thereof to adjust in response to contact with the awning sheet during installation. The sheet support structure of the prop device may be a convex, dome-shaped shell. The prop device may further include a prop rod to support the sheet support structure at a distance offset from the coupler. A manipulable joint may be provided to couple the sheet support structure to an end of the prop rod. The prop rod may be adjustably positionable to support the sheet support structure at a desired distance offset from the coupler. One or more complementary prop devices may be provided to cooperatively displace the awning sheet during use.

The awning sheet support system may further include a crossbar configured to span between the arm members of the awning, and the coupler of the prop device may couple the prop device to the arm members via the intermediary of the crossbar. The sheet support system may further include a bow system coupled between a pair of arm members of the awning, the bow system including a bow member aligned generally parallel to the lead member and being configured to flex upwardly to cooperatively support the awning sheet with the prop device. In some other instances, a pair of bow systems may be provided, each bow system coupled between a respective pair of overlapping pairs of arm members of the awning, and each bow system including a bow member aligned generally parallel to the lead member which is configured to flex upwardly to cooperatively support the awning sheet with the prop device.

According to another embodiment, a free-standing prop device is provided for preventing the accumulation of water on an awning sheet of an awning. The prop device may be summarized as including an elongated support member having a lower end and an upper end to span generally between a foundation and the awning sheet when the prop device is setup for use; a base at the lower end of the elongated support member to assist in stabilizing the prop device when the base is positioned on the foundation; and a sheet support structure at the upper end of the elongated support member having a generally convex upper surface to interface with the portion of the awning sheet and displace the portion of the awning sheet upwardly from a neutral unsupported position. The prop device may further include a manipulable joint provided between the sheet support structure and the upper end of the elongated support member to enable pivotable adjustment of the sheet support structure as the sheet support structure engages the awning sheet during setup. The elongated support member may be adjustable in length to enable selective height adjustment of the sheet support structure. The sheet support structure may be a convex, dome-shaped shell.

DETAILED DESCRIPTION

In the following description, certain specific details are set forth in order to provide a thorough understanding of various disclosed embodiments. However, one skilled in the relevant art will recognize that embodiments may be practiced without one or more of these specific details. In other instances, well-known structures associated with awning systems may not be shown or described in detail to avoid unnecessarily obscuring descriptions of the embodiments. Furthermore, it will be appreciated by those of ordinary skill in the relevant art that the systems, devices and related methods described herein for preventing the accumulation of water and/or debris on an awning sheet may be used with or practiced in connection with a wide variety of awning structures other than those illustrated herein.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

Figure 1:
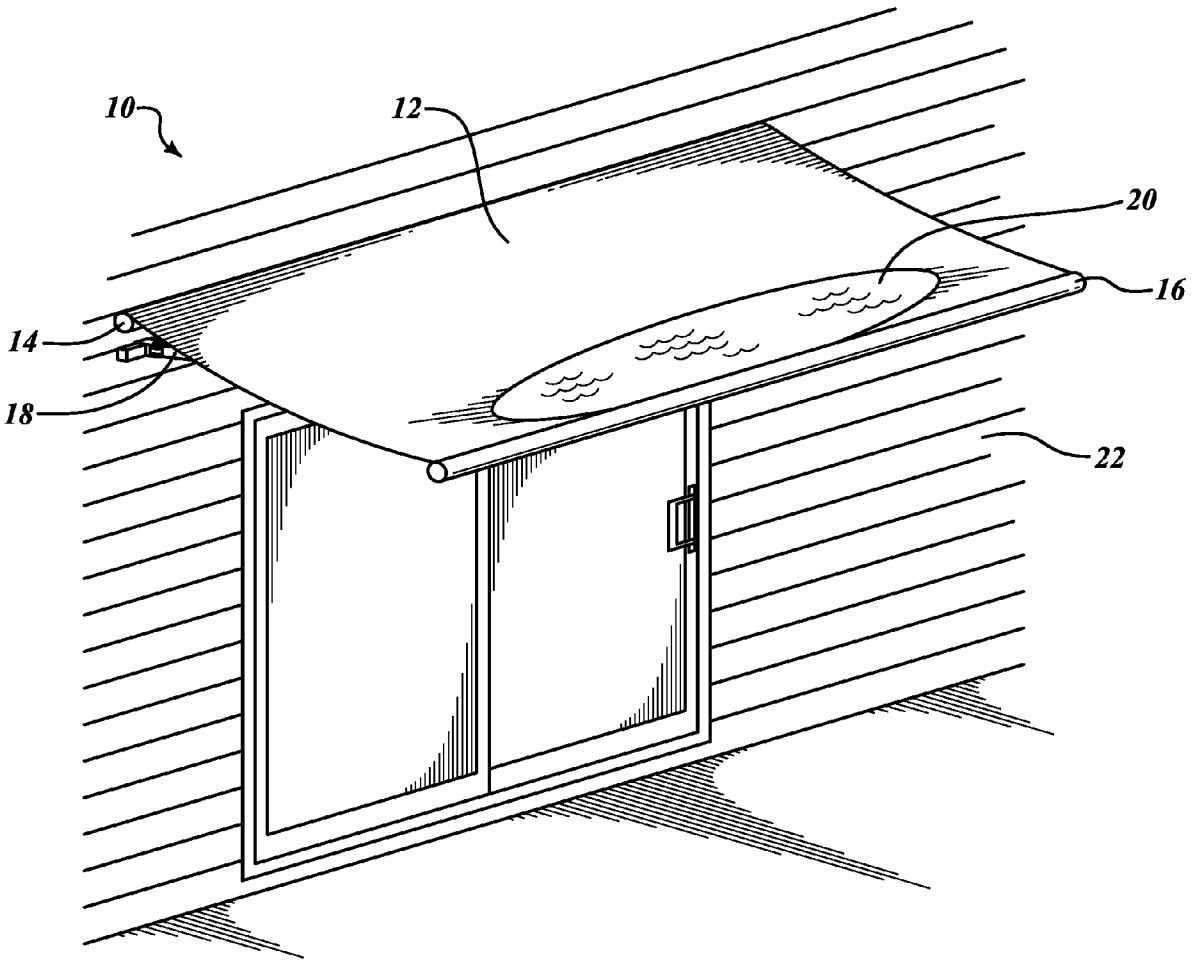
FIG. 1 (Prior Art)
FIG. 1 is an isometric view of a conventional awning structure showing an accumulation of water thereon.
Figure 2:
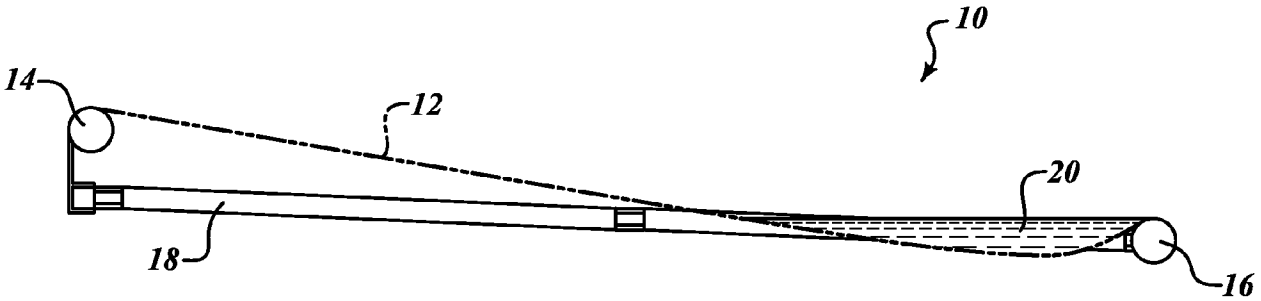
FIG. 2 (Prior Art)
FIG. 2 is a side elevational view of the conventional awning structure of FIG. 1 showing the accumulation of water thereon.
Figure 3:
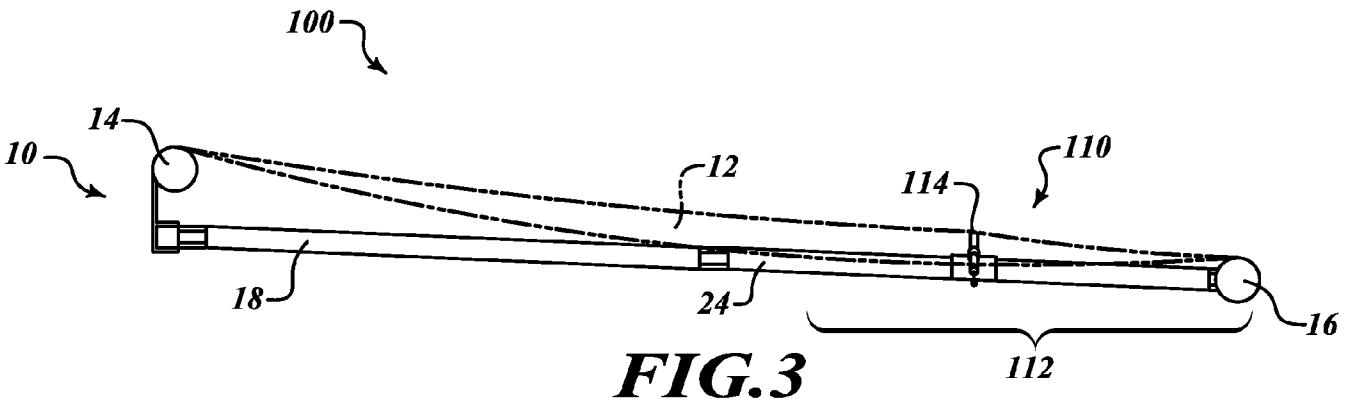
FIG. 3 is a side elevational view of an awning system including a bow system for preventing the accumulation of water or debris thereon, according to one embodiment. An awning sheet thereof is shown transparent to reveal the bow system.
Figure 4:
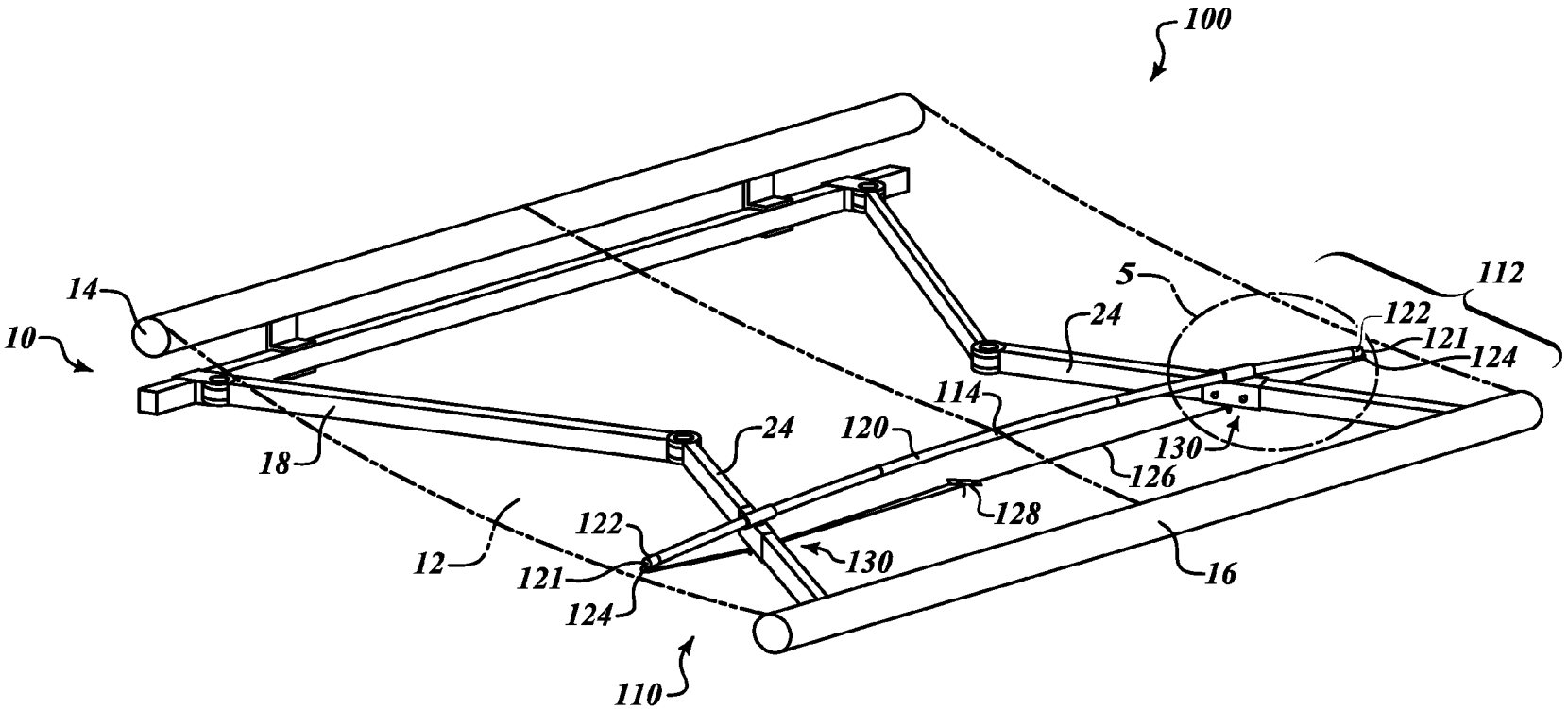
FIG. 4 is an isometric view of the awning system of FIG. 3 showing the awning sheet thereof transparent to reveal the bow system.

FIGS. 1 and 2 illustrate a conventional awning structure 10 having a pool of water 20 accumulated thereon. The awning structure 10 includes a retractable awning sheet 12 coupled between a base member 14 and a lead member 16. The lead member 16 is retractably extendable to move between an extended position in which the awning sheet 12 is supported between the base member 14 and the lead member 16 in a cantilevered manner from a house structure 22, as shown in FIG. 1, and a retracted position in which the awning sheet 12 is collected within the base member 14. The lead member 16 is coupled to the base member 14 by a pair of extendable arms 18 which articulate between a collapsed configuration and an expanded configuration to move the lead member 16 between the retracted position and the extended position, respectively. Further details of this type of conventional awning structure 10 can be found in U.S. Pat. No. 6,957,679, the entire content of which is incorporated herein by reference in its entirety.

FIGS. 3 through 7 show an awning system 100, according to one example embodiment, including the aforementioned awning structure 10 and a bow system 110 installed thereon to prevent water or debris from accumulating on the awning sheet 12 in a particularly efficient manner. The bow system 110 is mounted in a leading portion 112 of the awning structure 10 adjacent the lead member 16. For example, the bow system 110 may be coupled to each of a pair of leading arm members 24 of the pair of extendible arms 18 within a mounting region located beneath an area corresponding to a leading third of the awning sheet 12 which is adjacent the lead member 16 when the awning system 100 is in a deployed configuration. The bow system 110 is configured to flex upwardly during use to elevate a portion of the awning sheet 12. The bow system 110 is aligned generally parallel to the lead member 16 in a direction that is generally perpendicular to the direction of extension and retraction of the awning system 100. The bow system 110 flexes in a generally arched shape to direct water or debris toward the perimeter of the awning sheet 12. The bow system 110 may flex such that a peak 114 (FIGS. 3, 4 and 7) thereof is generated in a central region of the awning sheet 12 with respect to a direction corresponding to a longitudinal length of the bow system 110. According to the illustrated configuration, the bow system 110 is surprisingly effective in clearing water from the awning sheet 12 in a relatively simple form factor.

As shown best in FIGS. 4, 5, 6 and 7, the bow system 110 includes a bow member 120 coupleable to the leading arm members 24 of the awning structure 10 at intermediate positions along the longitudinal length of the bow member 120. The bow system 110 further includes end caps 121 at opposing ends 122 of the bow member 120. The opposing ends 122 of the bow member 120 are tethered together via a tensioning device 126 in the form of a tensioning cord coupled to eyelets 124 at the opposing ends 122. The tension in the tensioning device 126 may be readily adjusted by a tension adjustment mechanism 128. In this manner, a tension between the opposing ends 122 of the bow member 120 may be adjusted to increase or decrease the vertical displacement of the awning sheet 12 (FIGS. 3 and 4) to optimize a surface of the awning sheet 12 to shed water or debris. In some embodiments, the tension may be set such that a central portion of the bow member 120 displaces in a vertical direction at least four inches when transitioning between a relaxed configuration R (FIG. 6) and a flexed configuration F (FIG. 7) as the awning sheet 12 extends from a stowed configuration to a deployed configuration.

The bow member 120 of the bow system 110 is coupled to the leading arm members 24 of the awning structure 10 at each of opposing locations by respective couplers 130. More particularly, the couplers 130 each include a base portion 131 which is configured to engage a portion of a respective one of the pair of leading arm members 24 of the awning structure 10. For instance, as shown best in the cross-sectional view of FIG. 5A, the coupler 130 may include a base portion 131 in the form of a saddle having a cross-sectional profile which nests with the leading arm member 24. In some embodiments, the base portion 131 may couple to the leading arm member 24 by a snap-fit. For example, opposing legs 132 of the base portion 131 may be resilient and flex to receive the leading arm member 24 and snap back toward an initial state when the leading arm member 24 is fully received therein. Barbs 133, flanges or other features may be provided to assist in securing the base portion 131 to the leading arm member 24. Although the base portion 131 is shown as a generally u-shaped saddle structure, it is appreciated that the shape and size of the base portion may vary. Advantageously, the base portion 131 of the couplers 130 may be sized and shaped to nest closely with the leading arm members 24 in a relatively slender, yet robust form factor.

In some embodiments, fasteners, such as, for example, thumb screws 134 may be provided in addition to or in lieu of other attachment mechanisms to secure the base portion 131 to the leading arm member 24 and prevent the base portion 131 from shifting during use. The provision of thumb screws 134 enables rapid attachment and detachment of the couplers 130 to the leading arm members 24, although other fastening devices, such as, for example, conventional nuts and bolts, clamps and adhesives may be used. In some embodiments, including the example embodiment of FIGS. 3 through 7, the couplers 130 may enable attachment to the leading arm members 24 without requiring modifications thereto.

Figure 5:
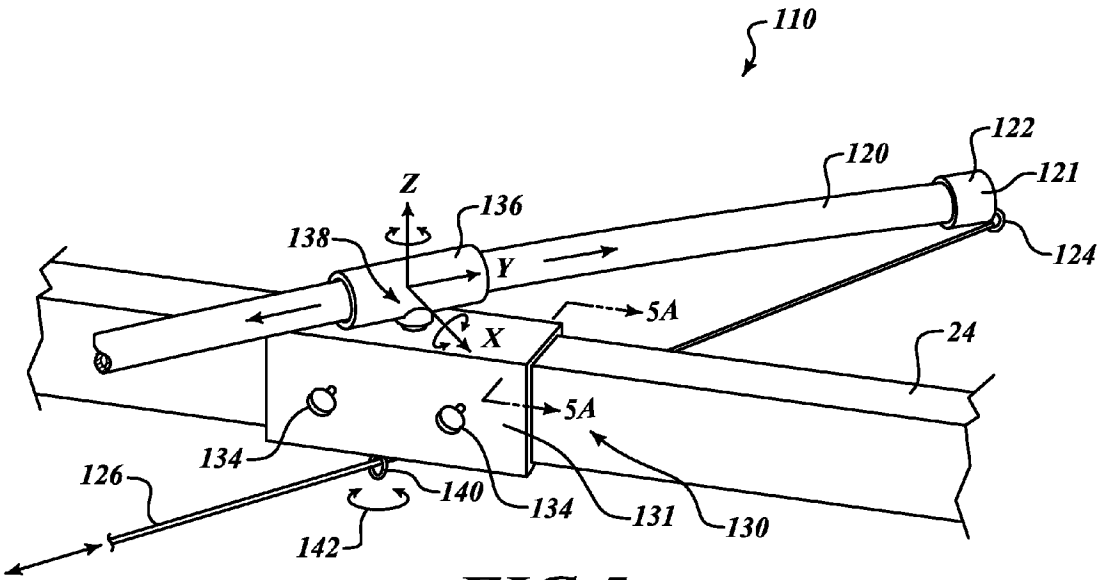
FIG. 5 is an isometric detail view of a portion of the awning system of FIG. 4.
Figure 5A:
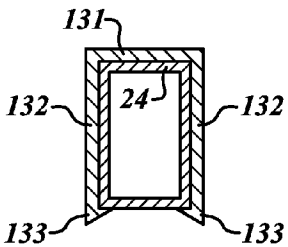
FIG. 5A is a cross-sectional view of a coupler of the bow system of FIG. 5 attached to an arm of the awning system.
Figure 6:
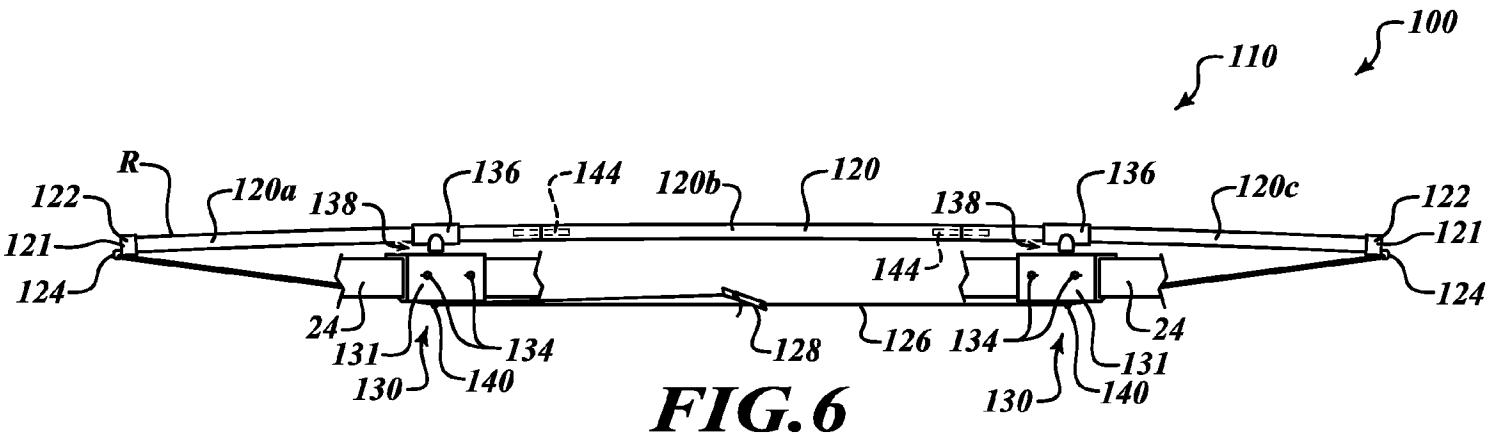
FIG. 6 is a front elevational view of the awning system of FIG. 3 shown with arms of the awning in a retracted configuration.
Figure 7:
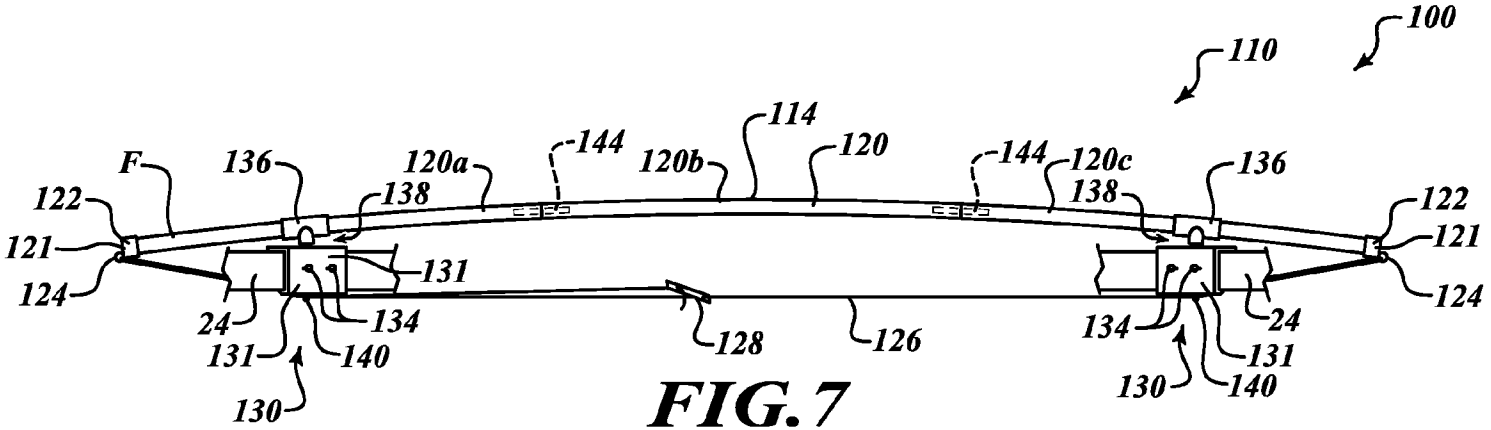
FIG. 7 is a front elevational view of the awning system of FIG. 3 shown with arms of the awning in an expanded configuration.

With reference to FIGS. 5, 6 and 7, the couplers 130 further include a bow support portion 136 that is coupled to the base portion 131 to move relative the base portion 131 during extension and retraction of the awning system 100. In some embodiments, the bow support portion 136 may include a tubular structure shaped to slidably receive the bow member 120. For example, as shown best in the detail view of the portion of the awning system 100 shown in FIG. 5, the bow support portion 134 may include a cylindrical tube shaped to closely receive a round, tubular bow member 120. In other embodiments, the bow support portion 136 may include a rectangular tube that is shaped to closely receive a bow member 120 having a rectangular cross-sectional profile. The bow support portion 136 may be coupled to the base portion 131 by one or more manipulable joints 138, such as, for example, a ball and socket joint, a universal joint and/or a clevis joint. As shown best in FIG. 5, the bow support portion 136 may be rotatable with respect to the base portion 131 about a vertical axis Z and a transverse axis X such that the bow support portion 136 is able to pitch and yaw relative to the base portion 131 when the awning system 100 moves between the retracted configuration and the deployed configuration. This functionality enables the bow member 120 to maintain a generally parallel relationship with the lead member 16 of the awning system 100 despite changes in direction of the base portion 131 during extension and retraction of the extendable arms 18 and hence leading arm members 24. In addition, it allows the bow member 120 to flex to a curved configuration and return to a relatively flat, relaxed configuration.

With reference to FIG. 5, the couplers 130 may further include an eyelet 140, an aperture or other feature through which the tensioning cord or other tensioning device 126 is routed. This can assist in keeping the bow system 110 in proper alignment throughout operation and prevent inadvertent binding. The eyelet 140 or other routing feature may be rotatably coupled to the coupler 130 as represented by the arrow labeled 142. In operation, at each of opposing ends of the bow system 110, the bow member 120, the respective coupler 130, and the tensioning device 126 up to the eyelet 140 or other routing feature may resemble a generally triangular configuration.

FIGS. 6 and 7 show the bow member 120 in a relaxed configuration R and a flexed configuration F, respectively. More particularly, FIG. 6 shows a partial front elevational view of the awning system 100 with the leading arm members 24 in a generally retracted configuration slightly before a fully retracted configuration. In this configuration, the couplers 130 on the leading arm members 24 are relatively close together which relieves tension between the opposing ends 122 of the bow member 120, allowing the bow member 120 to straighten into the generally relaxed configuration R. In contrast, FIG. 7 shows a partial front elevational view of the awning system 100 with the leading arm members 24 in a generally extended configuration. In this configuration, the couplers 130 on the leading arm members 24 are relatively further apart which imparts greater tension between the opposing ends of the bow member 120, forcing the bow member 120 to curve into the flexed configuration F. Advantageously, the bow member 120 may transition automatically between the relaxed configuration R and the flexed configuration F as the extendible arms 18 and hence leading arm members 24 extend and retract. Further, the bow system 110 may remain attached to the awning structure 10 throughout operation of the awning system 100. Accordingly, detachment of the bow system 110 is unnecessary when storing the awning sheet 12.

As further shown in FIGS. 6 and 7, the bow member 120 may comprise several sections 120*a*, 120*b*, 120*c* coupled together in an abutting relationship with adapters 144 or other connection devices therebetween. In this manner, the bow member 120 may be broken down into smaller sections 120*a*, 120*b*, 120*c* to facilitate handling and packaging. In some embodiments, for example, the bow member 120 may be broken down into sections 120*a*, 120*b*, 120*c* and packaged together with the couplers 130 in a relatively small form factor to be sold as an awning accessory kit.

Figure 8:
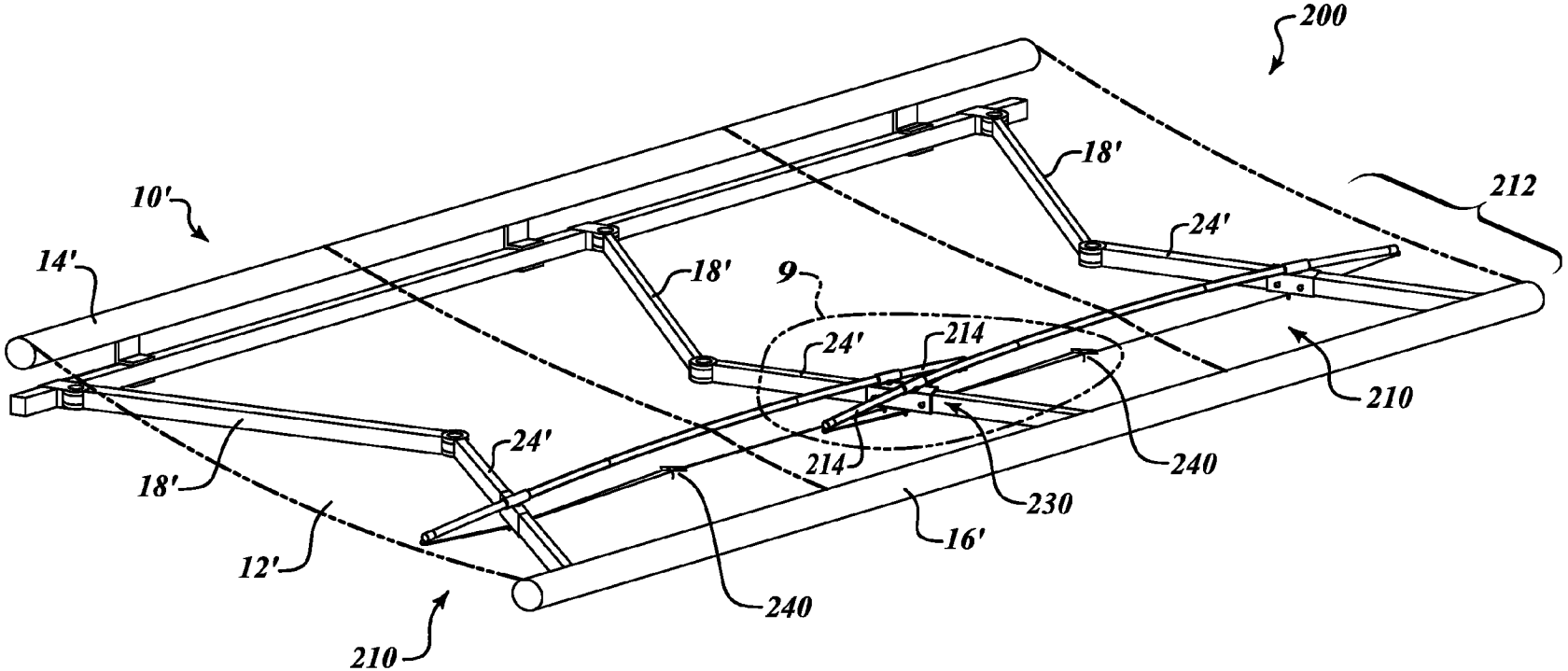
FIG. 8 is an isometric view of an awning system, according to one embodiment, including a pair of bow systems for preventing the accumulation of water or debris on a conventional awning structure. An awning sheet thereof is shown transparent to reveal the bow systems.
Figure 9:
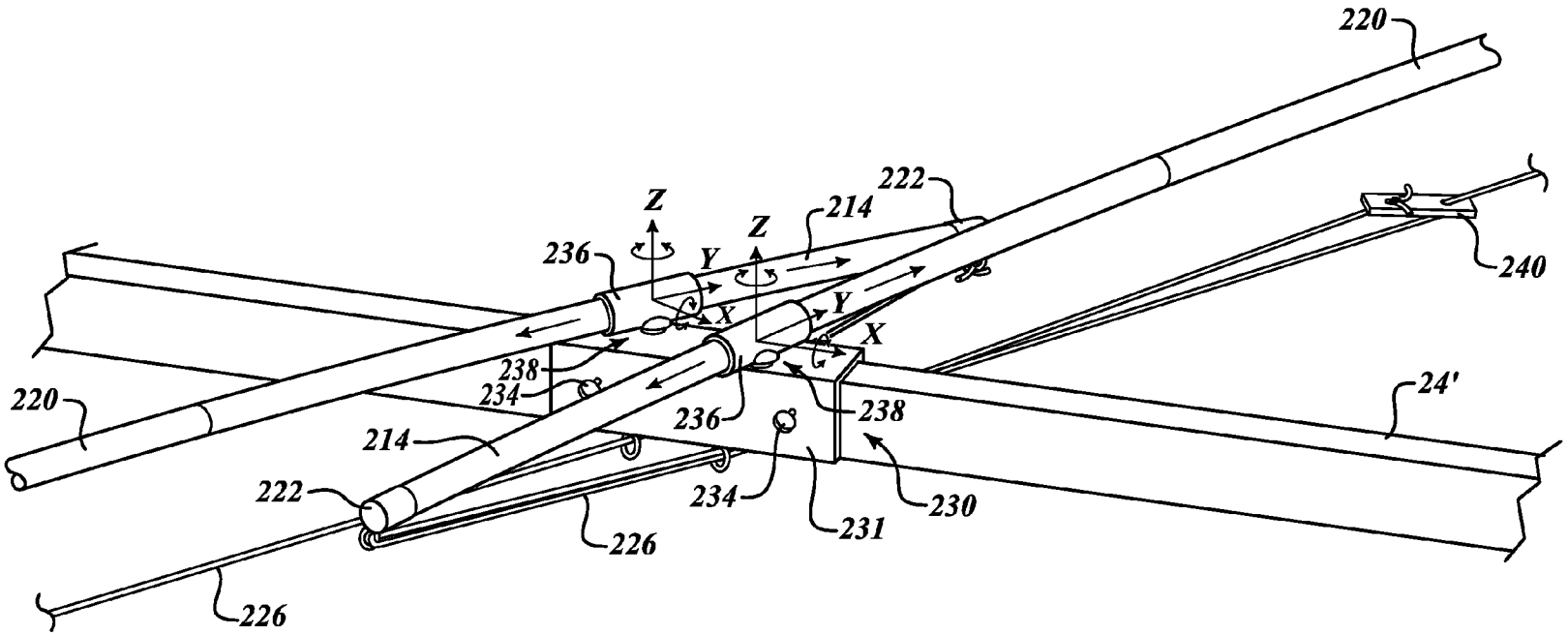
FIG. 9 is an isometric detail view of a portion of the awning system of FIG. 8.
Figure 10:
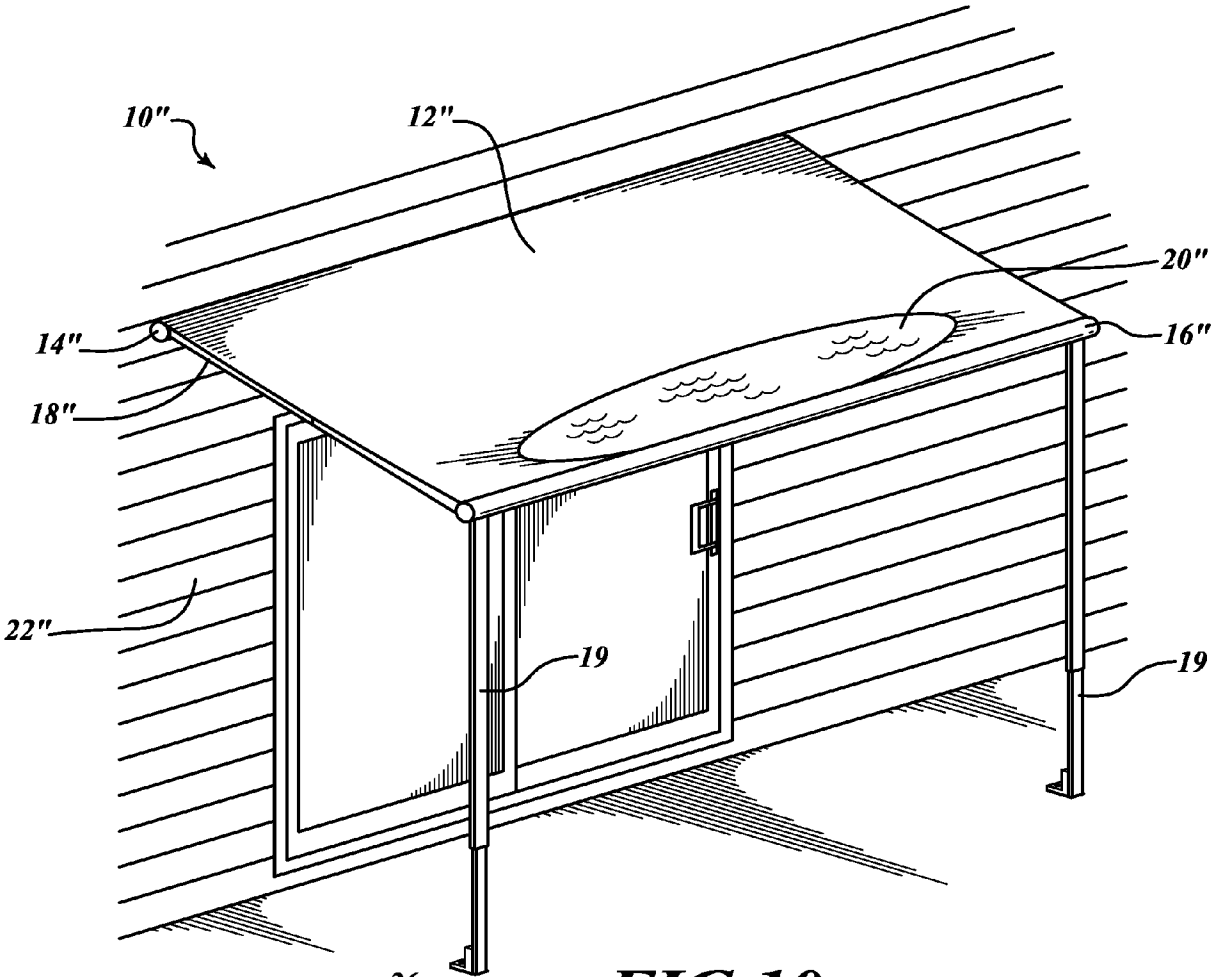
FIG. 10 (Prior Art)
FIG. 10 is an isometric view of another conventional awning system showing an accumulation of water thereon.

FIGS. 8 and 9 show an awning system 200, according to another example embodiment, including a conventional awning structure 10' and a pair of cooperating bow systems 210 installed thereon to prevent water or debris from accumulating on the awning sheet 12' in a particularly efficient manner. The bow systems 210 are mounted in a leading portion 212 of the awning structure 10' adjacent a lead member 16' thereof. For example, the bow systems 210 may be coupled between overlapping pairs of leading arm members 24' of corresponding extendible arms 18' within a mounting region located beneath an area corresponding to a leading third of the awning sheet 12' which is adjacent the lead member 16' when the awning system 200 is in a deployed configuration. The bow systems 210 are configured to flex upwardly during use to cooperatively elevate portions of the awning sheet 12' in an overlapping manner. The bow systems 210 are aligned generally parallel to the lead member 16' in a direction that is generally perpendicular to the direction of extension and retraction of the awning system 200. In addition, the bow systems 210 are nested in close proximity to each other such that, when the awning system 200 is in the retracted configuration, the bow systems 210 may be stored above the leading arm members 24' in a compact arrangement. The bow systems 210 may remain coupled to the awning structure 10' throughout deployment and retraction of the awning structure 10' without interference.

Other features and aspects of the awning system 200 are similar to those described above. However, one notable difference is that the ends 214 of the bow systems 210 which overlap are shown as coupling to a leading arm member 24' via a common coupler 230. In other embodiments, however, it is appreciated that the common coupler 230 may be replaced with two separate, distinct couplers each dedicated to a respective one of the bow systems 210.

The common coupler 230 of the example embodiment of FIGS. 8 and 9 includes a base portion 231 which is configured to engage a portion of the leading arm member 24'. For instance, the coupler 230 may include a base portion 231 in the form of a saddle having a cross-sectional profile which nests with the leading arm member 24', including, for example, by way of a snap-fit. In some embodiments, fasteners, such as, for example, thumb screws 234 may be provided in addition to or in lieu of other attachment mechanisms to secure the base portion 231 to the leading arm member 24' and prevent the base portion 231 from shifting during use. Similar to the earlier discussion, the provision of thumb screws 234 enables rapid attachment and detachment of the coupler 230 to the leading arm member 24', although other fastening devices, such as, for example, conventional nuts and bolts, clamps and adhesives may be used. In some embodiments, including the example embodiment of FIGS. 8 and 9, the coupler 230 may enable attachment to the leading arm member 24' without requiring modifications thereto.

With continued reference to FIGS. 8 and 9, the common coupler 230 further includes a respective bow support portion 236 for each of bow members 220 of the bow systems 210. The bow support portions 236 are movably coupled to the base portion 231 to adjust relative the base portion 231 to enable movement of the bow members 220 received therein relative to the leading arm member 24'. In some embodiments, the bow support portions 236 may include a tubular structure shaped to slidably receive the bow members 220. Similar to earlier discussions, the bow support portions 236 may be coupled to the base portion 231 by one or more manipulable joints 238, such as, for example, a ball and socket joint, a universal joint and/or a clevis joint. As depicted best in the detail view of the portion of the awning system 200 shown in FIG. 9, each of the bow support portions 236 are rotatable with respect to the base portion 231 about a vertical axis Z and a transverse axis X such that each of the bow support portions 134 are able to pitch and yaw relative to the base portion 231. This functionality enables the bow members 220, throughout operation, to maintain a generally parallel relationship with the lead member 16' of the awning system 200 and allows the bow members 220 to flex to a curved configuration and return to a relatively flat, relaxed configuration.

It is appreciated that some of the leading arm members 24' of the awning structure 10' may operate in a parallel relationship with the attachment locations of the bow system 210 being maintained at the same distance throughout extension and retraction of the awning structure 10'. In this scenario, tension may be released manually from the bow system 210 prior to retraction of the awning structure 10' by utilizing a tension adjuster 240 to flatten out the corresponding bow member 220 for storage. The bow system 210, however, may remain fully assembled and attached to the awning structure 10' throughout operation. In this manner, a user may conveniently deploy the awning structure 10' and erect the bow systems 210 with minimal effort by re-tensioning the bow member 220 when the awning structure 10' is deployed.

Figure 11:
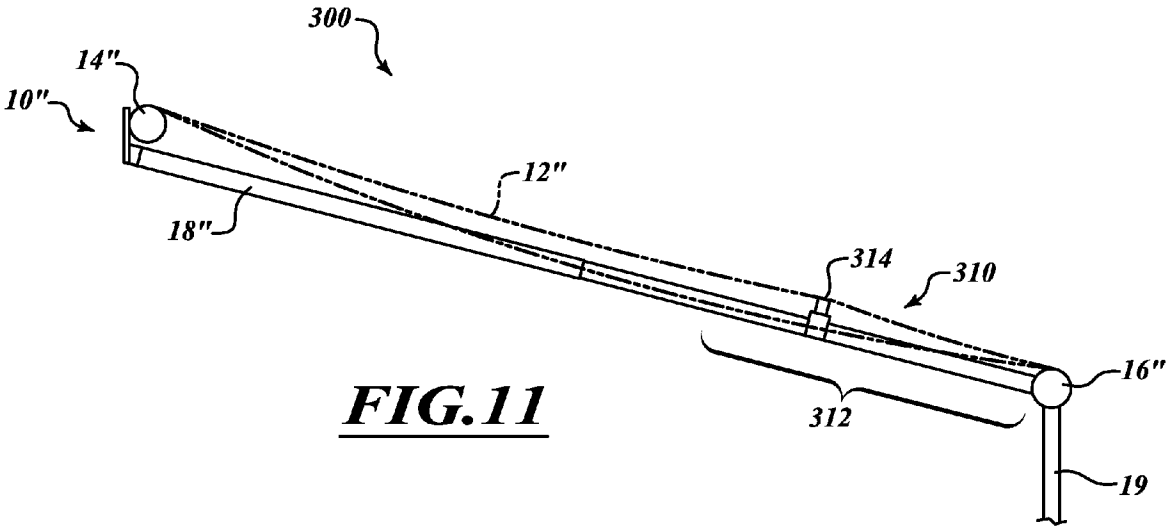
FIG. 11 is a side elevational view of an awning system including a bow system for preventing the accumulation of water or debris thereon, according to another embodiment.
Figure 12:
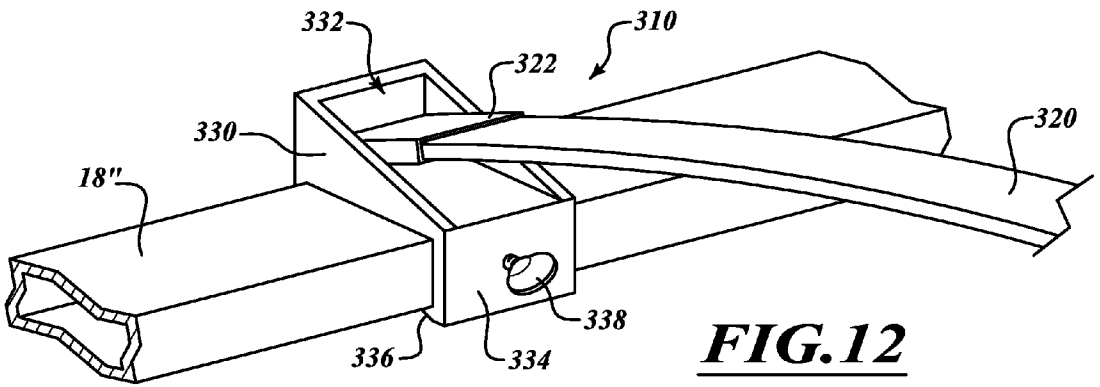
FIG. 12 is an isometric detail view of a portion of the bow system of FIG. 12 coupled to an arm of the awning structure.

FIGS. 11 and 12 show an awning system 300, according to yet another example embodiment, including a conventional awning structure 10" and a bow system 310 installed thereon to prevent water or debris from accumulating on an awning sheet 12" thereof in a particularly efficient manner. The bow system 310 is mounted in a leading portion 312 of the awning structure 10" adjacent a lead member 16". For example, the bow system 310 may be coupled to each of a pair of arms 18" of the awning structure 10" within a mounting region located beneath an area corresponding to a leading third of the awning sheet 12" which is adjacent the lead member 16" when the awning system 300 is in a deployed configuration. The bow system 310 is configured to flex upwardly during use to elevate a portion of the awning sheet 12". The bow system 310 is aligned generally parallel to the lead member 16" in a direction that is generally perpendicular to the direction of extension and retraction of the awning system 300. The bow system 310 flexes in a generally arched shape to direct water or debris toward the perimeter of the awning sheet 12". The bow system 310 may flex such that a peak 314 (FIG. 11) thereof is generated in a central region of the awning sheet 12" with respect to a direction corresponding to a longitudinal length of the bow system 310. According to the illustrated configuration, the bow system 310 is surprisingly effective in clearing water from the awning sheet 12" in a relatively simple form factor.

As shown in FIG. 12, the bow system 310 includes a bow member 320 having an elongated structure with each of opposing ends 322 thereof receivable in a respective mounting device 330 secured to a corresponding arm 18" of the awning structure 10". Each mounting device 330 may include a cup-structure or other cavity 332 for receiving the end 322 of the bow member 320 in a secure, yet unfixed manner. In this way, a user may readily remove the bow member 320 with minimal effort. The mounting device 330 may further include opposing legs 334 which form a saddle-like portion having a profile corresponding to the arm 18" of the awning structure 10". Barbs 336, flanges or other features may be provided to assist in securing the opposing legs 334 of the mounting device 330 to the arm 18". Although the opposing legs 334 of the mounting device 330 are shown as forming a generally u-shaped saddle structure, it is appreciated that the shape and size of the mounting device 330 may vary. Advantageously, the mounting device 330 may be sized and shaped to nest closely with the arms 18" of the awning structure 10" in a relatively slender, yet robust form factor.

In some embodiments, fasteners, such as, for example, thumb screws 338 may be provided in addition to or in lieu of other attachment mechanisms to secure the mounting devices 330 to the arms 18" of the awning structure 10" and prevent the mounting devices 330 from shifting during use. The provision of thumb screws 338 enables rapid attachment and detachment of the mounting devices 330 to the arms 18" of the awning structure 10", although other fastening devices, such as, for example, conventional nuts and bolts, clamps and adhesives may be used. In some embodiments, including the example embodiment of FIGS. 11 and 12, the mounting devices 330 may enable attachment to the arms 18" of the awning structure 10" without requiring modifications thereto. In other embodiments, the arms 18" of the awning structure 10" may be modified to receive the mounting devices 330.

Figure 13:
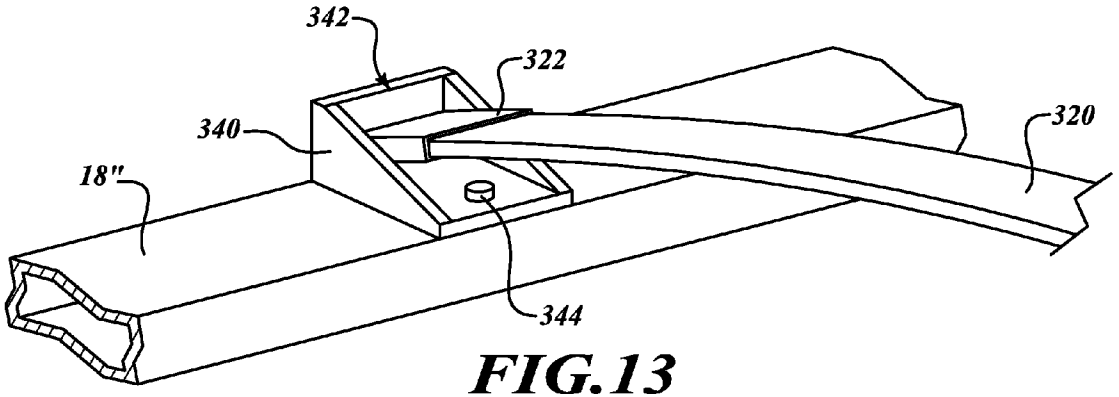
FIG. 13 is an isometric detail view of a portion of a bow system, according to another embodiment, coupled to an arm of an awning structure.

For example, FIG. 13 shows a variation of the embodiment of FIGS. 11 and 12 in which the arms 18" of the awning structure 10" have been modified to include mounting apertures to receive fasteners 344 for fixedly securing mounting devices 340 thereto. The fasteners 344 may be bolts, clevis pins or other fasteners. In one particular embodiment, the fasteners 344 may be clevis pins and may be secured to the arms 18" of the awning structure 10" with hairpins or other quick release devices which facilitate rapid disassembly of the mounting devices 340 from the arms 18" of the awning structure 10". The mounting devices 340 of this embodiment may likewise include a cup-structure or other cavity 342 for receiving the end 322 of the bow member 320 in a secure, yet unfixed manner. In other embodiments, the bow member 320 may be fixedly attached to the mounting devices 340.

Figure 14:
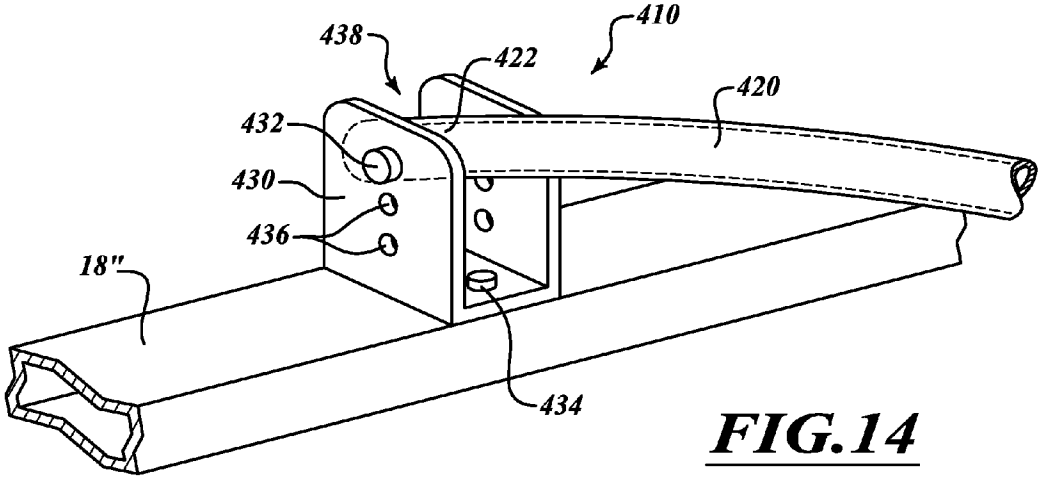
FIG. 14 is an isometric detail view of a portion of a bow system, according to yet another embodiment, coupled to an arm of an awning structure.

For example, FIG. 14 illustrates a variation of a bow system 410 in which a round, tubular bow member 420 is fixedly secured at opposing ends 422 thereof to mounting devices 430 with fasteners 432. The mounting devices 430 in turn are secured to the arms 18" of the awning structure 10" with fasteners 434. The fasteners 432, 434 may be bolts, clevis pins or other fasteners. The mounting devices 430 may include a series of apertures 436 to enable selective adjustment of the ends 422 of the bow member 420 to vary a height thereof. In this manner, the profile of the awning sheet which is elevated by the bow member 420 during use may be adjusted to improve runoff or to accommodate variations between various types of conventional awning structures. Furthermore, in some applications, a user may advantageously adjust the height of one end 422 of the bow member 420 higher than the other to route runoff in a particular direction so as to avoid walkways or other areas in which it may be undesirable to direct the runoff. For example, one end 422 of the bow member 420 may be elevated one inch or more higher than the other end 422 such that water and/or debris tends to flow to the side of the awning structure 10" adjacent the end 422 that is lower.

Figure 15:
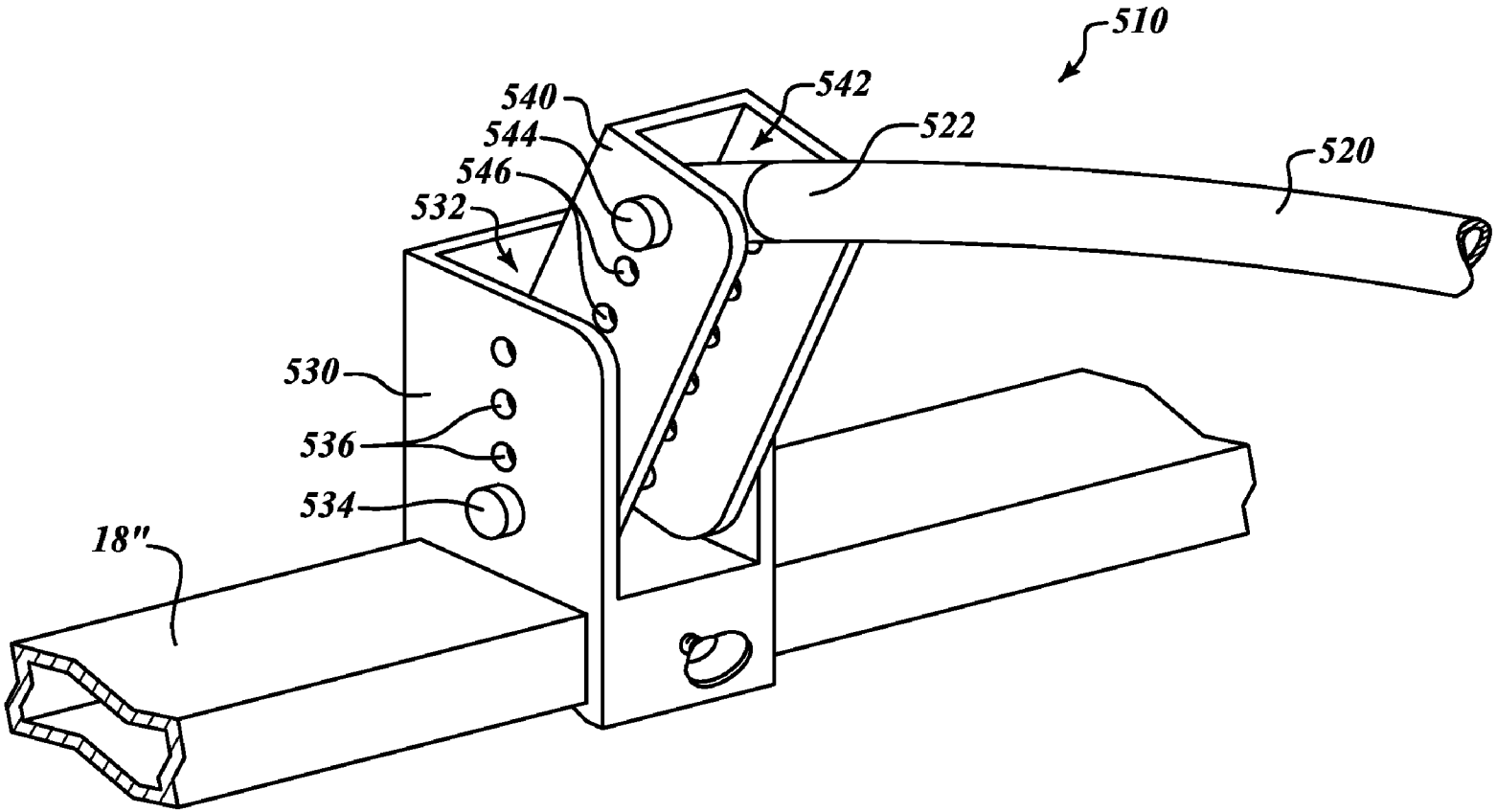
FIG. 15 is an isometric detail view of a portion of a bow system, according to still yet another embodiment, coupled to an arm of an awning structure.

FIG. 15 illustrates yet another variation of a bow system 510 in which mounting devices 530 are secured to the arms 18" of the awning structure 10". An upper portion of the mounting devices 530 each define a channel 532 to receive a respective intermediate bow adjustment device 540 which is pivotally coupleable to the mounting device 530. More particularly, each intermediate bow adjustment device 540 is rotatably secured within the channel 532 of the corresponding mounting device 530 with a fastener 534 extending through one of a series of apertures 536 therein. In turn, an end 522 of the bow member 520 is secured within a channel 542 of the intermediate bow adjustment device 540 with a fastener 544 extending through one of a series of apertures 546 therein. This linkage arrangement of the mounting devices 530 and intermediate bow adjustment devices 540 enables a wide breadth of flexibility in positioning each of the opposing ends 522 of the bow member 520 to achieve a desirable loft of the awning sheet elevated thereby. In addition, similar to the discussion above, in some applications, a user may advantageously adjust the height of one end 522 of the bow member 520 higher than the other to route runoff in a particular direction so as to avoid walkways or other areas in which it may be undesirable to direct the runoff.

In accordance with the various awning systems described herein, corresponding methods of using bow systems 110, 210, 310, 410, 510 to prevent the accumulation of water or debris on awning structures are provided. For instance, in some embodiments, a method of preventing the accumulation of water or debris on an awning sheet of an awning structure may include coupling an elongated bow system between extendible arms of the awning structure such that a bow member thereof is positioned below a leading portion of the awning sheet and aligned generally perpendicular to a direction of extension of the awning structure. The method may further include setting a tension between opposing ends of the bow member such that the bow member flexes a determined amount from a generally straight configuration as the awning structure is deployed. The method may further include selectively adjusting a tension between opposing ends of the bow member to modify an amount of flex thereof. The method may also include selectively adjusting a height of at least one of the opposing ends of the bow member such that water impinging on the awning sheet is routed to one side of the awning more than the other. The method may also include storing the bow system automatically with storage of the awning sheet. These and other aspects of methods of preventing the accumulation of water or debris on an awning sheet will be appreciated by those of ordinary skill in the relevant art upon a review of the present disclosure.

Figure 16:
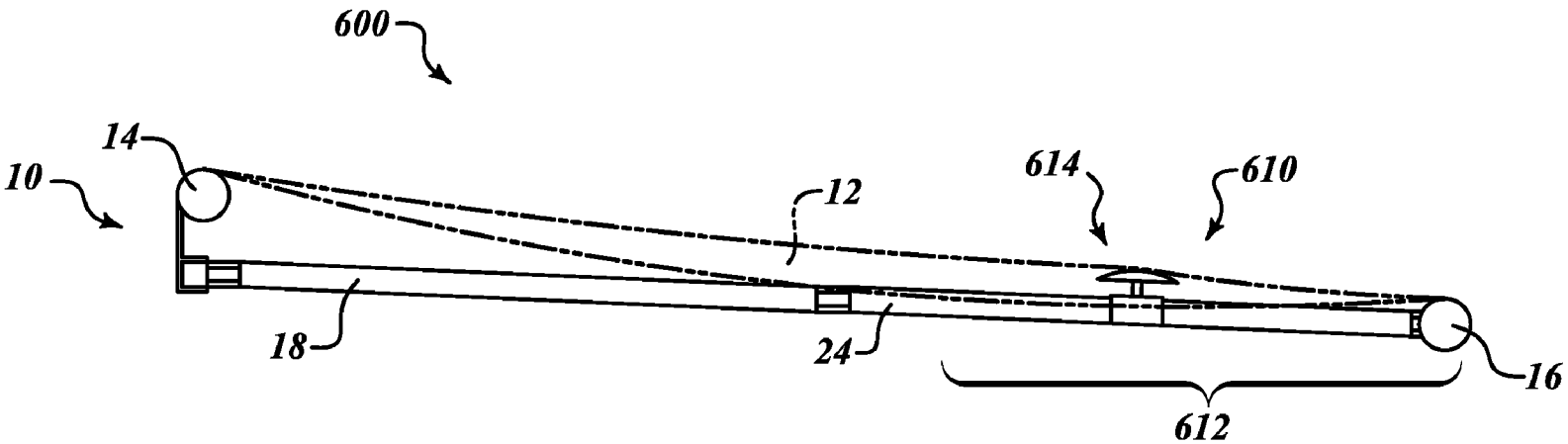
FIG. 16 is side elevational view of an awning system including an awning sheet support system having prop devices to prevent the accumulation of water or debris thereon, according to one embodiment. An awning sheet thereof is shown transparent to reveal the prop devices.
Figure 17:
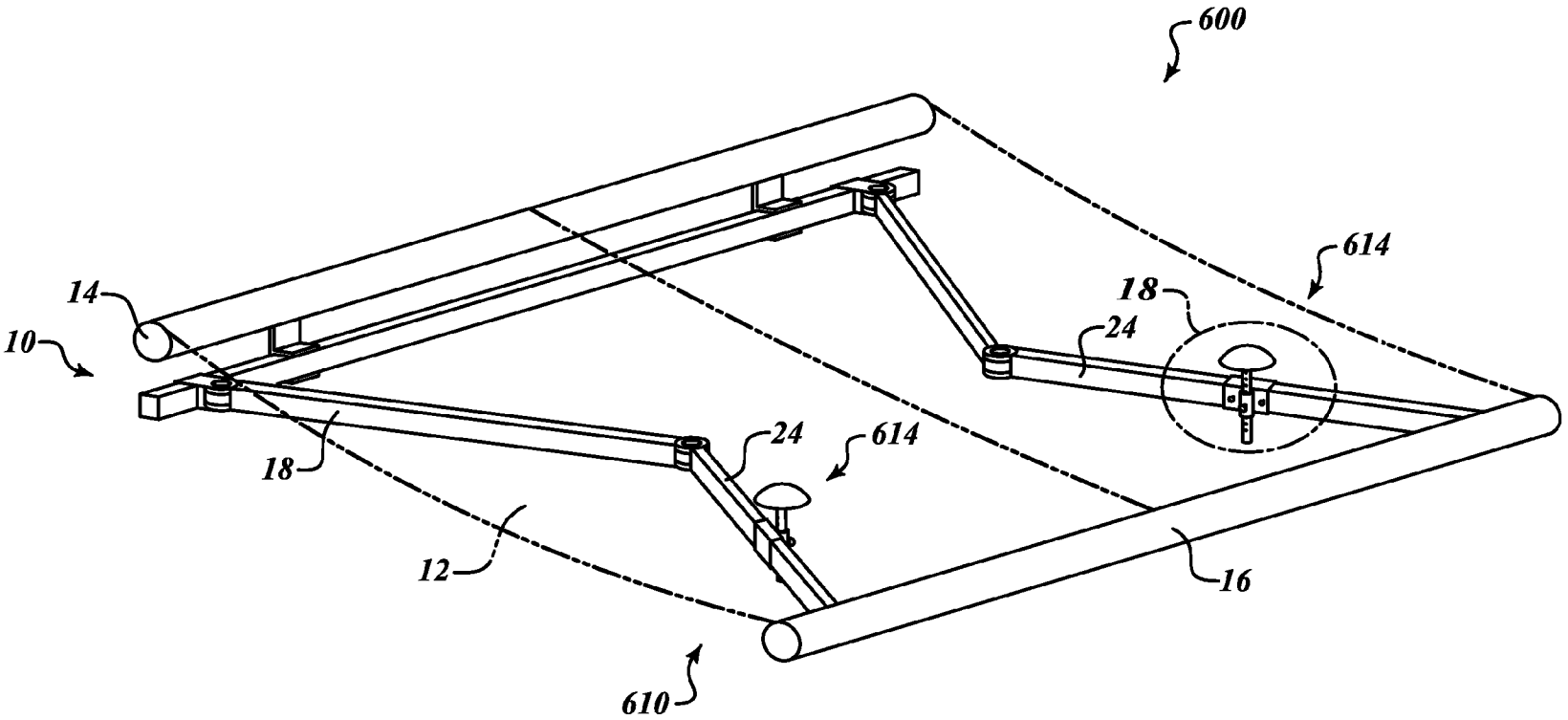
FIG. 17 is an isometric view of the awning system of FIG. 16 showing the awning sheet thereof transparent to reveal the prop devices.
Figure 18:
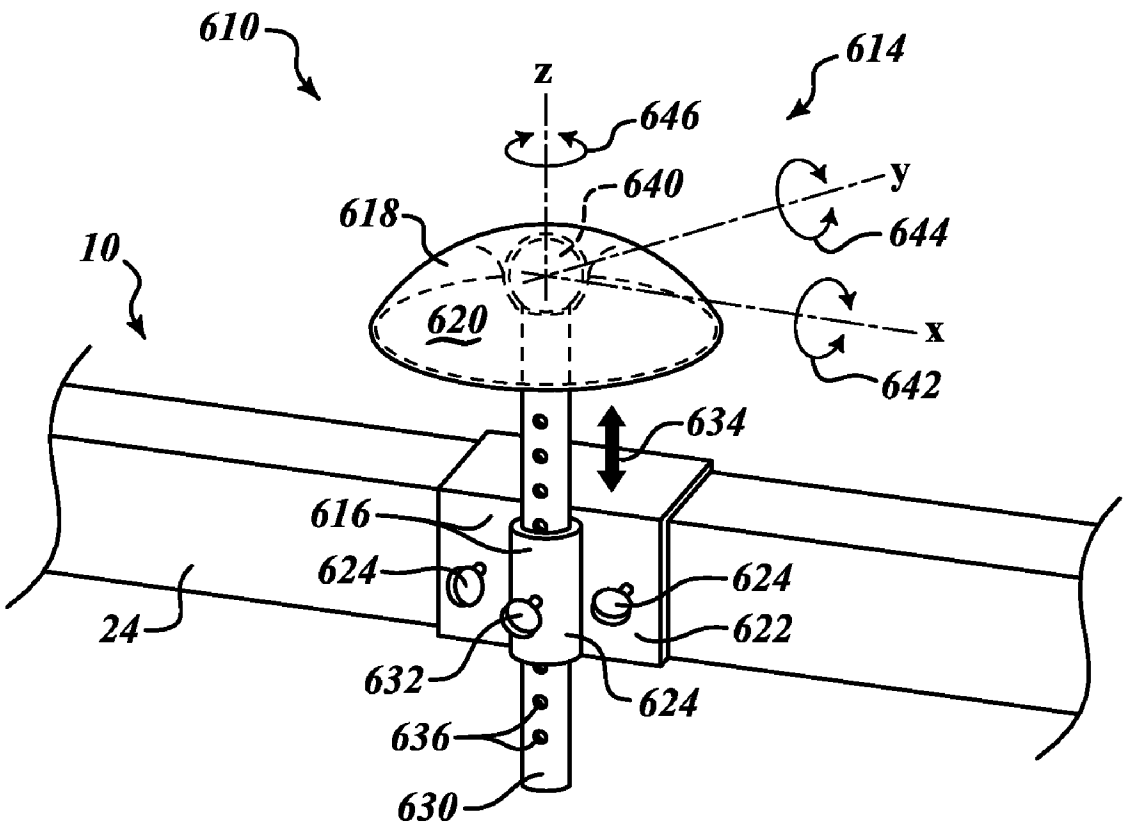
FIG. 18 is an isometric detail view of a portion of the awning system of FIG. 17.

FIGS. 16 through 18 show an awning system 600, according to another example embodiment, which includes the aforementioned awning structure 10 and an awning sheet support system 610 installed thereon to prevent water and/or debris from accumulating on the awning sheet 12. The awning sheet support system 610 may be mounted in a leading portion 612 of the awning structure 10 adjacent the lead member 16. For example, the awning sheet support system 610 may be coupled to leading arm members 24 of the pair of extendible arms 18 within a mounting region located beneath an area corresponding to a leading third of the awning sheet 12 which is adjacent the lead member 16 when the awning system 600 is in a deployed configuration.

As best shown in FIG. 17, the awning sheet support system 610 includes a pair of prop devices 614 that are positioned during use to collectively elevate a portion or portions of the awning sheet 12. In some embodiments, the awning sheet support system 610 may include more or fewer prop devices 614. Each of the prop devices 614 may be identical to each other and may be adjustable in height to displace the portion or portions of the awning sheet 12 to a greater or lesser degree. In addition, an upper portion of the prop device 614 may be pivotally adjustable to interface with the awning sheet 12 in a dynamically adaptive manner and may have a convex upper surface to with the awning sheet 12 during use.

Further details of the prop device 614 are shown best in FIG. 18. As shown, the prop device 614 includes a coupler 616 to couple the prop device 614 to an arm member 24 or other structure of the awning 10 and a sheet support structure 618 with a generally convex upper surface 620 to interface with a portion of the awning sheet 12 when the prop device 614 is installed for use. The coupler 616 of the prop device 614 has an engagement portion 622 configured to selectively engage the arm member 24 or other structure of the awning 10 and another portion 624 to receive and support the sheet support structure 618 in an upwardly directed orientation when the engagement portion 622 is attached to the awning 10. The engagement portion 622 may be in the form of a saddle having a cross-sectional profile which nests with the leading arm member 24 or other structure of the awning 10. In some embodiments, the engagement portion 622 may couple to the leading arm member 24 by a snap-fit. For example, opposing legs of the engagement portion 622 may be resilient and flex to receive the leading arm member 24 and snap back toward an initial state when the leading arm member 24 is fully received therein. Barbs, flanges or other features may be provided to assist in securing the engagement portion 622 to the leading arm member 24. Although the engagement portion 622 is shown as a generally u-shaped saddle structure, it is appreciated that the shape and size of the engagement portion 622 may vary. Advantageously, the engagement portion 622 of the coupler 616 may be sized and shaped to nest closely with the leading arm member 24 or other structure in a relatively slender, yet robust form factor.

In some embodiments, fasteners, such as, for example, thumb screws 624 may be provided in addition to or in lieu of other attachment mechanisms to secure the engagement portion 622 to the leading arm member 24 and prevent the engagement portion 622 and hence prop device 614 from shifting during use. The provision of thumb screws 624 or similar fasteners enables rapid attachment and detachment of the coupler 616 to the leading arm member 24, although other fastening devices, such as, for example, conventional nuts and bolts, clamps and adhesives may be used. In some embodiments, including the example embodiment of FIGS. 16 through 18, the couplers 616 of the prop devices 614 may enable attachment to the leading arm members 24 or other structures of the awning 10 without requiring modifications thereto.

The other portion 624 of the coupler 616 may be provided in the form of a tubular structure for slidably receiving a prop rod 630 which is attached directly or indirectly to the sheet support structure 618. The tubular structure may be sized and shaped to closely receive the prop rod 630 and may be provided with selective engagement features or fasteners 632, such as, for example, a spring loaded pin or thumb screw, for selectively engaging the prop rod 624 at various adjustable heights, as represented by the arrow labeled 634. A series of apertures 636, depressions or other features may me provided along the length of the prop rod 630 to interoperate with the engagement features or fasteners 632 to securely hold the prop rod 630 at the various adjustable heights. In this manner, a user may quickly extend or retract the prop rod 630 and hence the sheet support structure 618 to impart or relieve pressure on the awning sheet 12 there above. Although the prop rod 630 is illustrated as having a circular cross-section, the prop rod 630 may vary in shape and include both open and closed cross-sectional profiles.

The prop rod 630 may be attached directly to the sheet support structure 618 with fasteners or may be integrally formed therewith. Alternatively, the prop rod 630 may be attached indirectly to the sheet support structure 618, such as, for example, by the intermediary of a manipulable joint 640. The manipulable joint 640 may be a ball and socket joint which is free to rotate about each of three primary axes of rotation as illustrated by the arrows labeled 642, 644 and 646. In this manner, the sheet support structure 618 may adjust orientation in response to contact with the awning sheet 12 during installation. More particularly, as a generally convex upper surface 620 of the sheet support structure 618 is forced into the awning sheet 12 with increasing pressure during installation or setup, the sheet support structure 618 may pivot to align with a surface of the displaced awning sheet 12. In other embodiments, a manipulable joint 640 may be provided having fewer or different degrees of freedom than a ball and socket joint, such as, for example, a hinge structure which is rotatable only about a single rotational axis.

Although the combination of the prop rod 630 and sheet support structure 618 may resemble a mushroom-like structure, the prop rod 630 and sheet support structure 618 may have different shapes and configurations. Further, in some embodiments, the upper surface 620 of the sheet support structure 618 may be relatively flat or have a generally shallow convex surface, or in other embodiments, may have a generally steep convex surface. Still further, in some embodiments the upper surface 620 may be sized such that the expected area of contact between the upper surface 620 and the awning sheet 12 is relatively small, such as, for example, four square inches or less. In other embodiments, the upper surface 620 may be sized such that expected area of contact may be relatively large, such as, for example, twenty square inches or more.

Figure 19:
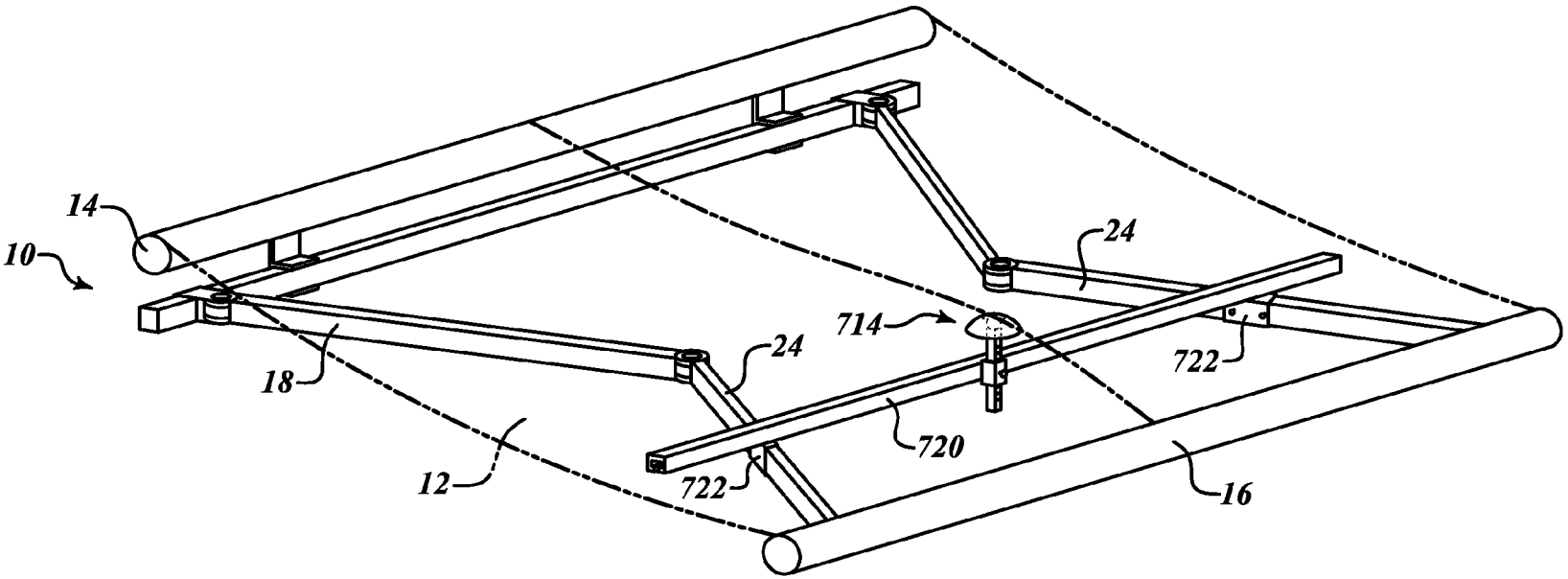
FIG. 19 is an isometric view of an awning system including an awning sheet support system having a prop device to prevent the accumulation of water or debris thereon, according to another embodiment. An awning sheet thereof is shown transparent to reveal the prop device.

In some embodiments, additional supplementary support structures may be provided to enable one or more prop devices to be positioned in a particularly advantageous region beneath the awning sheet 12. For example, FIG. 19 illustrates an embodiment of an awning sheet support system 710 in which a single prop device 714 is supported in a central region between arm members 24 of an awning structure 10 by a crossbar 720 spanning therebetween. The crossbar 720 is coupled to the arm members 24 with couplers 722 having structures similar to other couplers described herein for coupling to arm members 24 without modifications thereto. In other embodiments, the crossbar 720 may be coupled to the arm members 24 or other structures of the awning 10 with other attachment devices, including, for example, conventional fasteners.

The crossbar 720 may clip, snap, slide-over or otherwise interface with the couplers 722 and/or prop device 714 in a quick release fashion to facilitate assembly and disassembly of the awning sheet support system 710. In other embodiments, the crossbar 720 may be bolted or otherwise fastened in a more secure manner to the couplers 722 and/or prop device 714. In still other embodiments, the crossbar 720 may be integrally joined or formed together with the couplers 722 and/or prop device 714.

Irrespective of the connection methods or mechanisms, the components of the awning sheet support system 710 shown in FIG. 19 interoperate to allow flexibility in positioning and locating a prop device 714 beneath a desired location of the awning sheet 12 and are advantageous in adapting the prop device 714 for use with various conventional awning structures 10 which may not have support members in such desired locations. For example, it is appreciated that various supplemental support structures, including cross members 720, may be arranged among and connected to existing structures of all types of conventional awnings to position one or more prop devices 714 in desired locations. The prop devices 714 may be selectively located on existing structures of the conventional awnings and/or supplemental support structures connected thereto, such as, for example, a supplemental crossbar 720. Accordingly, prop devices 714 may be located in those regions most efficient for shedding water and/or debris from the awning sheet 12 or for routing water and/or debris to a desired location, such as, for example, locations remote from walkways or pathways.

In some embodiments, prop devices 614, 714 may be coupled to an awning structure together with one or more of the bow systems 110, 210, 310, 410, 510 described herein. For example, in the illustrated embodiment of FIG. 8, a prop device 614, 714 may be positioned near where the pair of bow systems 210 overlap to displace a central area of the awning sheet 12' within the leading portion 212 of the awning structure 10'. In this manner, the prop device 614, 714 and bow systems 210 may cooperate to impart a particularly efficient displaced shape of the awning sheet 12 for shedding water and/or debris therefrom.

Figure 20:
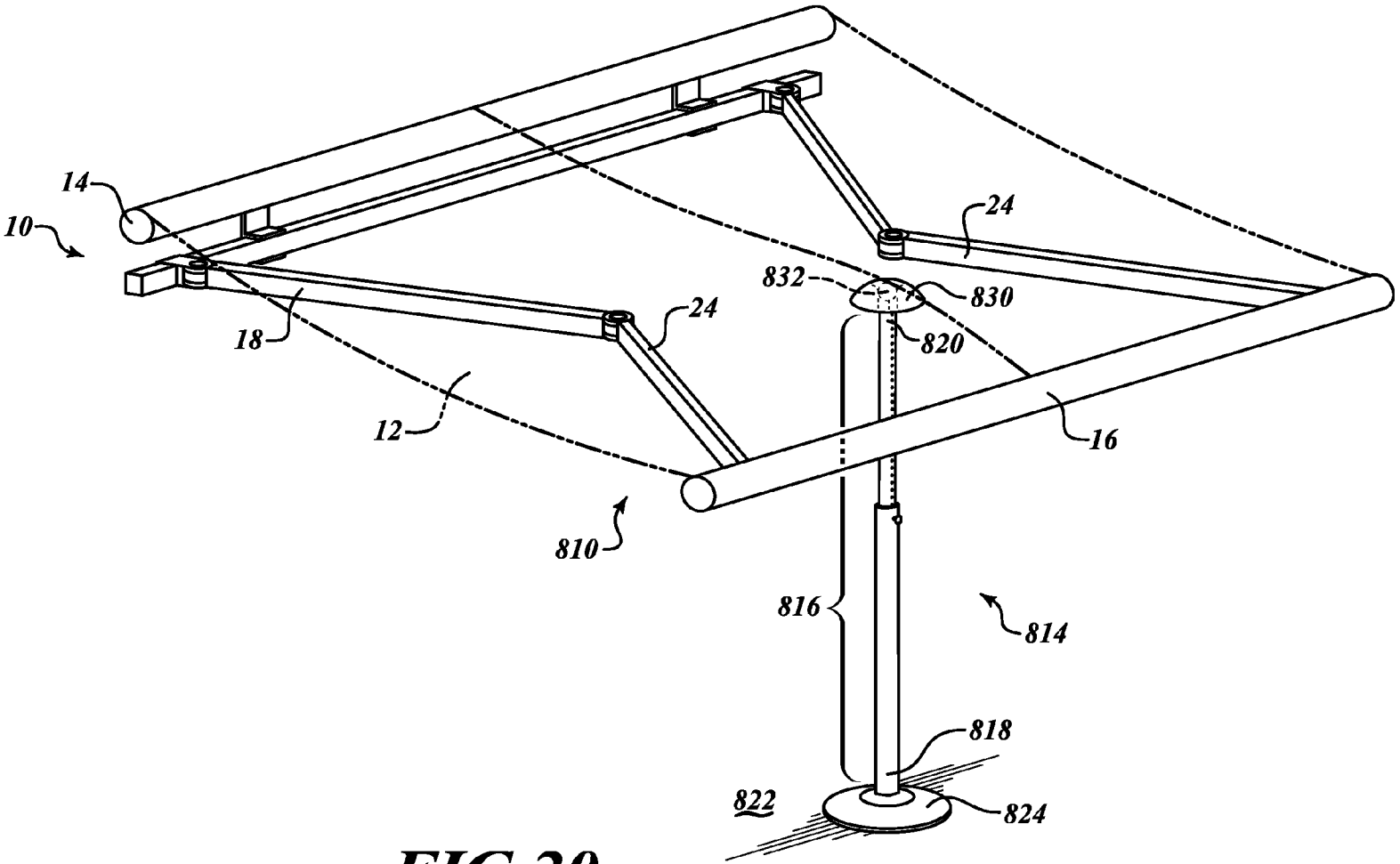
FIG. 20 is an isometric view of an awning system including a prop device to prevent the accumulation of water or debris thereon, according to yet another embodiment. An awning sheet thereof is shown transparent to reveal portions of the prop device.

Still further, according to some embodiments, a prop device may be provided which is not attached or otherwise secured to an awning structure 10 but is nevertheless configured to displace a portion of an awning sheet 12 thereof to prevent the accumulation of water and/or debris. For example, as shown in FIG. 20, a prop device 814 may be provided having an elongated support member 816 with a lower end 818 and an upper end 820 spanning generally between a foundation 822 (e.g., ground, floor, deck, etc.) and the awning sheet 12 when the prop device 814 is setup for use. The prop device 814 may further include a base 824 at the lower end 818 of the elongated support member 816 to assist in stabilizing the prop device 814 when the base 824 is positioned on the foundation 822.

The prop device 814 may also include a sheet support structure 830 at the upper end 820 of the elongated support member 816 with a generally convex upper surface to interface with the portion of the awning sheet 12 and displace the portion of the awning sheet 12 upwardly from a neutral unsupported position. The sheet support structure 830 may be a convex, dome-shaped shell or frisbee-like structure. In some embodiments, the upper surface of the sheet support structure 830 may be sized such that the expected area of contact between the upper surface and the awning sheet 12 is relatively small, such as, for example, four square inches or less. In other embodiments, the upper surface of the sheet support structure 830 may be sized such that the expected area of contact may be relatively large, such as, for example, twenty square inches or more. In some embodiments, the sheet support structure 830 may be formed as an umbrella-like structure which is selectively retractable and deployable. In this manner, the sheet support structure 830 may be provided with a relatively large profile during use while retaining the ability to collapse to relatively small profile for storage.

In some embodiments, the prop device 814 may further include a manipulable joint 832 provided between the sheet support structure 830 and the upper end 820 of the elongated support member 816 to enable pivotable adjustment of the sheet support structure 830 as the sheet support structure 830 engages the awning sheet 12. The manipulable joint 832 may be, for example, a ball and socket joint which is free to rotate about each of three primary axes of rotation or another type of joint having more or fewer or different degrees of freedom.

The elongated support member 816 is preferably adjustable in length to enable selective height adjustment of the sheet support structure 830. For example, the elongated support member 816 may be formed of telescoping members as illustrated in FIG. 20. In other embodiments, the elongated support member 816 may comprise a plurality of interconnected segments which can be combined in different quantities to support the sheet support structure 830 at different selectable heights during use.

According to the illustrated embodiment of FIG. 20, the prop device 814 provides a particularly efficient means of supporting an awning sheet 12 in a displaced manner to shed water and/or debris without requiring physical attachment to the existing awning structure 10. The prop device 814 can be deployed and stored quickly with minimal effort and presents only a minor obstruction to the usable space beneath the awning sheet 12. While only one prop device 814 is illustrated in FIG. 20, two or more prop devices 814 may be provided to cooperatively displace a portion or portions of the awning sheet 12.

Again, in the foregoing description, certain specific details are set forth in order to provide a thorough understanding of various disclosed embodiments. However, one skilled in the relevant art will recognize that embodiments may be practiced without one or more of these specific details. Moreover, the various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A bow system for a retractable awning having a base member and a lead member that is retractably extendable to move between an extended position in which an awning sheet is supported in a cantilevered manner between the base member and the lead member and a retracted position, the lead member coupled to the base member by a pair of extendable arms, the bow system comprising:

a pair of couplers, each coupler having a base portion configured to engage a portion of a respective one of the pair of extendible arms of the awning and having a bow support portion coupled to the base portion to move relative the base portion during extension and refraction of the awning; and a bow coupleable at intermediate positions along a longitudinal length thereof to the pair of extendible arms of the awning by the pair of couplers, the bow including a bow member configured to flex into a curved configuration as the awning moves from the retracted position to the extended position, and the bow including a tension device coupled between opposing ends of the bow member to assist in moving the bow member to the curved configuration as the awning moves toward the extended position.

2. The bow system of claim 1 wherein the base portion of each coupler includes a saddle sized and shaped to closely receive the portion of the respective one of the pair of extendible arms of the awning.

3. The bow system of claim 2 wherein the saddle is configured to snap-fit onto the portion of the respective one of the pair of extendible arms of the awning.

4. The bow system of claim 1 wherein the base portion of each coupler further includes at least one fastener for fixing the base portion to the respective extendible arm of the awning.

5. The bow system of claim 1 wherein each coupler includes a joint between the base portion and the bow support portion to enable the bow support portion to pitch and yaw relative to the base portion when the awning moves between the retracted position and the extended position.

6. The bow system of claim 5 wherein the joint includes at least one of a ball and socket joint, a universal joint and a clevis joint.

7. The bow system of claim 1 wherein the bow support portion of each coupler includes a tubular support section sized and shaped to slidably receive the bow member.

8. The bow system of claim 7 wherein the bow member is a cylindrical tube and the bow support portion of each coupler includes a cylindrical tubular support section.

9. The bow system of claim 7 wherein the bow member is a flat bar and the bow support portion of each coupler includes a rectangular tubular support section.

10. The bow system of claim 1 wherein the tension device includes a tension adjuster to adjust an amount of tension between the opposing ends of the bow member.

11. The bow system of claim 1 wherein the tension device is coupled to each of the pair of couplers such that, at each of opposing ends of the bow system, the bow member, the tension device and the respective coupler resemble a triangular configuration when the bow system is in operation and the awning is in the extended position.

12. The bow system of claim 1 wherein, during operation, the bow member automatically flexes toward the curved configuration as the awning moves toward the extended position.

13. The bow system of claim 1 wherein the bow member includes a plurality of bow member sections coupled together in an abutting relationship.

14. The bow system of claim 1 wherein the bow system is packaged as an awning accessory kit.

15. The bow system of claim 1, further comprising:

a supplemental bow coupleable at intermediate positions along a length thereof to one of the pair of extendible arms of the awning and a third extendible arm of the awning, the supplemental bow including a tension device coupled between opposing ends thereof to move a bow member of the supplemental bow to a curved configuration.

16. The bow system of claim 15, wherein one of the pair of couplers is configured to support each of the bow and the supplemental bow.

17. An awning system, comprising:

an awning having an awning sheet coupled between a base member and a lead member to form a canopy structure when the awning is in a deployed configuration in which the lead member is spatially offset from the base member, the lead member supported in space at least in part by a pair of arm members when the awning is in a deployed configuration; and a bow system coupled between the pair of arm members in a mounting region located beneath an area corresponding to a leading portion of the awning sheet adjacent the lead member when the awning is in the deployed configuration, the bow system including a bow member aligned generally parallel to the lead member and configured to flex upwardly to elevate a portion of the awning sheet when the awning is in the deployed configuration and including a pair of couplers, each coupler having a base portion configured to engage a portion of a respective one of the pair of arms of the awning and having a bow support portion coupled to the base portion to move relative the base portion as the awning moves between the deployed configuration and a retracted configuration.

18. The awning system of claim 17 wherein the pair of arms are extendible and wherein the bow member automatically flexes upwardly during operation to elevate the portion of the awning sheet when the pair of arms move toward an extended position to transition the awning to the deployed configuration.

19. The awning system of claim 17, further comprising:

a prop device configured to couple to at least one of the arm members, the prop device having a sheet support structure with a generally convex upper surface to interface with the awning sheet when the prop device is installed for use.

20. An awning system, comprising:

an awning having an awning sheet coupled between a base member and a lead member to form a canopy structure when the awning is in a deployed configuration in which the lead member is spatially offset from the base member, the lead member supported in space at least in part by a pair of arm members when the awning is in a deployed configuration; and a bow system coupled between the pair of arm members in a mounting region located beneath an area corresponding to a leading portion of the awning sheet adjacent the lead member when the awning is in the deployed configuration, the bow system including a bow member aligned generally parallel to the lead member and configured to flex upwardly to elevate a portion of the awning sheet when the awning is in the deployed configuration and including a pair of couplers, each coupler configured to engage a portion of a respective one of the pair of arms of the awning and to receive one of opposing ends of the bow member, a distance between the couplers being less than a length of the bow member such that, when the bow member is received in the couplers and tensioned, the bow member flexes upwardly to elevate the portion of the awning sheet.

* * * * *